US008567093B2

(12) United States Patent
Sato

(10) Patent No.: US 8,567,093 B2
(45) **Date of Patent: *Oct. 29, 2013**

(54) MIDFOOT STRUCTURE OF A SOLE ASSEMBLY FOR A SHOE

(75) Inventor: Natsuki Sato, Kawanishi (JP)

(73) Assignee: Mizuno Corporation, Osaka-shi (JP)

( * ) Notice: Subject to any disclaimer, the term of this patent is extended or adjusted under 35 U.S.C. 154(b) by 281 days.

This patent is subject to a terminal disclaimer.

(21) Appl. No.: 13/013,052

(22) Filed: Jan. 25, 2011

(65) Prior Publication Data

US 2011/0113656 A1 May 19, 2011

Related U.S. Application Data

(62) Division of application No. 11/825,394, filed on Jul. 6, 2007, now Pat. No. 7,886,461.

(30) Foreign Application Priority Data

Aug. 30, 2006 (JP) ..... 2006-232920

(51) Int. Cl.
*A43B 13/28* (2006.01)
*A43B 13/18* (2006.01)

(52) U.S. Cl.
USPC ..... 36/27; 36/28

(58) Field of Classification Search
USPC ..... 36/27, 28, 29, 30 R, 35 R
See application file for complete search history.

(56) References Cited

U.S. PATENT DOCUMENTS

| | | | |
|---|---|---|---|
| 4,535,553 | A | 8/1985 | Derderian et al. |
| 4,536,974 | A | 8/1985 | Cohen |
| 6,389,713 | B1 | 5/2002 | Kita |
| 6,516,539 | B2 | 2/2003 | Nishiwaki et al. |
| 6,625,905 | B2 | 9/2003 | Kita |
| 6,685,011 | B2 | 2/2004 | Nishiwaki et al. |
| 6,826,852 | B2 | 12/2004 | Fusco |
| 6,860,034 | B2 | 3/2005 | Schmid |
| 7,484,317 | B2 | 2/2009 | Kita et al. |
| 7,513,065 | B2 | 4/2009 | Kita et al. |
| 7,624,515 | B2 | 12/2009 | Kita et al. |

(Continued)

FOREIGN PATENT DOCUMENTS

| | | |
|---|---|---|
| DE | 101 23 511 | 1/2002 |
| EP | 0 990 397 | 4/2000 |

(Continued)

*Primary Examiner* — Jila M Mohandesi
(74) *Attorney, Agent, or Firm* — W. F. Fasse

(57) ABSTRACT

A midsole structure of a sole assembly for a shoe improves a ride feeling and stability of the midfoot portion of the sole assembly during running. The sole assembly 1' of the shoe includes an upper plate 3 formed of a hard elastic member disposed on an upper side of a midfoot region M, a lower midsole 15 formed of a soft elastic member disposed under the upper plate 3 at the midfoot region, wherein the lower midsole has a downwardly convexedly curved upper surface that forms a void S relative to the upper plate and contacts the upper plate at the front and rear ends of the midfoot portion, and an outsole. The outsole includes a midfoot outsole 6 with a ground contact surface arranged below the lower midsole at the midfoot region, a heel outsole 5 of a heel region H, and a forefoot outsole 7 of a forefoot region F, wherein these outsole members are all discrete and separate from one another in the longitudinal direction.

9 Claims, 7 Drawing Sheets

(56) References Cited

U.S. PATENT DOCUMENTS

| | | | | |
|---|---|---|---|---|
| 7,707,743 | B2 | 5/2010 | Schindler et al. | |
| 7,886,461 | B2 * | 2/2011 | Sato | 36/27 |
| 2001/0052194 | A1 | 12/2001 | Nishiwaki et al. | |
| 2003/0000109 | A1 | 1/2003 | Kita | |
| 2003/0005600 | A1 | 1/2003 | Kita | |
| 2008/0052965 | A1 | 3/2008 | Sato | |

FOREIGN PATENT DOCUMENTS

| | | |
|---|---|---|
| JP | 9-248203 | 9/1997 |
| JP | 2000-106905 | 4/2000 |
| JP | 2001-321201 | 11/2001 |
| JP | 2003-009906 | 1/2003 |
| JP | 2003-019004 | 1/2003 |
| JP | 2004-267516 | 9/2004 |
| JP | 2006-136715 | 6/2006 |

* cited by examiner

MIDFOOT STRUCTURE OF A SOLE ASSEMBLY FOR A SHOE

CROSS-REFERENCE TO RELATED APPLICATION

This application is a Divisional and claims the benefit under 35 USC 120 and 121 of U.S. application Ser. No. 11/825,394 filed on Jul. 6, 2007 and issued as U.S. Pat. No. 7,886,461 on Feb. 15, 2011, the entire disclosure of which is incorporated herein by reference.

BACKGROUND OF THE INVENTION

The present invention relates generally to a midfoot structure of a sole assembly for a shoe, and more particularly, to an improvement in the structure for enhancing a ride feeling during running and improving stability of the midfoot portion of the shoe.

Japanese patent application laying-open publication Nos. 2003-19004 and 2006-136715 show a midfoot structure of a sole assembly for a shoe.

JP reference 2003-19004 describes a tubular or D-shaped plastic shank member that has a longitudinal length greater than the vertical length and that is disposed at the midfoot portion of a shoe. In this case, the shank member increases the bending rigidity of the midfoot portion to restrain the bending deformation of the midfoot portion, thereby relatively increasing the bending properties of the forefoot portion. Also, in this case, a void formed in the shank member improves the cushioning properties of the midfoot portion.

JP reference 2003-19004 discloses a shank member of two-layered plate structure disposed in the midfoot portion of the shoe. However, this midfoot structure is not constructed such that the sole midfoot portion contacts the ground. Also, a description in the light of improving the ride feeling during running is not made in the JP reference.

On the other hand, JP reference 2006-136715 describes a first arch-shaped reinforcement plate disposed under the arch-shaped surface at the midsole bottom surface via a void. In this case, the first arch-shaped reinforcement plate enhances the rigidity of the midfoot portion, and the void formed between the arch-shaped surface of the midsole and the first arch-shaped reinforcement plate functions such that the first arch-shaped reinforcement plate does not impede a downward deformation of the arch-shaped surface at the midsole bottom surface when the load from the sole of a shoe wearer's foot acts on the midsole to compressively deform the midsole at the time of striking onto the ground. Thereby, a press from the ground onto the sole of the shoe wearer's foot relieved at the time of striking onto the ground. In addition, JP reference 2006-136715 also shows a second arch-shaped or flat reinforcement plate disposed under the first arch-shaped reinforcement plate to strengthen the first arch-shaped reinforcement plate.

Though JP reference 2006-136715 discloses a plate-like shank member disposed at the midfoot portion of the shoe, this midfoot structure is not constructed such that the sole midfoot portion contacts the ground. A description in the light of enhancing the ride feeling during running is not given in the JP reference either.

An object of the present invention is to provide a midfoot structure of a sole assembly for a shoe that can improve the ride feeling during running and enhancing the stability of the midfoot portion.

SUMMARY OF THE INVENTION

A midfoot structure of a sole assembly for a shoe according to a first aspect of the present invention includes an upper plate of a hard elastic member disposed on the upper side of a midfoot portion of the sole assembly, a lower midsole of a soft elastic member disposed below the upper plate at the midfoot portion, having a downwardly convexedly curved upper surface to form a void with the tipper plate, and contacting the upper plate on the front end side and the rear end side of the midfoot portion, and a midfoot outsole with a ground contact surface attached on the lower surface of the lower midsole at the midfoot portion and disposed discretely in the longitudinal direction from an outsole on a heel portion and an outsole on a forefoot portion of the sole assembly.

A midfoot structure of a sole assembly for a shoe according to a second aspect of the present invention includes an upper plate of a hard elastic member disposed on the upper side of a midfoot portion, a lower plate of a hard elastic member disposed below the upper plate at the midfoot portion and having a downwardly convexedly curved shape to form a void with the upper plate, a midfoot outsole with a ground contact surface attached on the lower surface of the lower plate at the midfoot portion and disposed discretely in the longitudinal direction from an outsole on a heel portion and an outsole on a forefoot portion of the sole assembly, and connections provided on the front end side and the rear end side of the midfoot portion and interconnecting the upper plate with the lower plate in the vertical direction.

The upper plate may extend longitudinally in a generally flat shape or an upwardly convexedly curved shape at the midfoot portion.

The upper plate may have a laterally extending wavy shape with longitudinally extending ridge lines.

An upper midsole of a soft elastic member may be attached on the upper surface of the upper plate.

The midfoot portion may be disposed in the region defined by 0.35L to 0.55L, measuring from the heel rear end edge of the sole assembly, where L is the entire length of the sole assembly.

The rear end of the midfoot portion may be disposed in the position defined by 0.35L to 0.45L, measuring from the heel rear end edge of the sole assembly, and the front end of the midfoot portion may be disposed in the position defined by 0.45L to 0.55L, measuring from the heel rear end edge of the sole assembly.

A lower plate of a hard elastic member may be provided on the upper surface of the lower midsole and the lower plate may have a downwardly convexedly curved shape to form a void with the upper plate.

The upper plate may have hardness greater than that of the lower plate.

According to the first aspect of the present invention, since the midfoot outsole longitudinally separated from the outsole on the heel portion side and the outsole on the forefoot portion of the sole assembly is disposed at the midfoot portion of the sole assembly, the ground contact surface of the midfoot outsole contacts the ground when the shoe wearer strikes onto the ground from the heel portion of the sole assembly and the load is transferred toward the forefoot portion. At this juncture, since the lower midsole disposed under (i.e. on the side close to the ground) the midfoot portion has the upper surface of a downwardly convexedly curved shape to form the void with the upper plate, the lower plate can deform upwardly, thereby securing the cushioning properties of the midfoot portion. As a result, when the load is transferred from the heel portion through the midfoot portion to the forefoot portion, a smooth load transfer is made possible and a ride feeling during running can be improved.

Moreover, in this case, since the upper plate disposed above (i.e. on the side close to the shoe wearer's foot) the midfoot portion is formed of a hard elastic member, deformation (i.e. bending and torsional deformation) of the upper plate can be restrained when the load is applied to the midfoot portion. Thereby, the support rigidity relative to the arch portion of the wearer's foot can improve and the stability as the midfoot portion of the shoe can be secured.

According to the second aspect of the present invention, since the midfoot outsole longitudinally separated from the outsole on the heel portion and the sole on the forefoot portion of the sole assembly is disposed at the midfoot portion of the sole assembly, the ground contact surface of the midfoot outsole contacts the ground when the shoe wearer strikes onto the ground from the heel portion of the sole assembly and the load is transferred toward the forefoot portion. At this juncture, since the lower plate disposed under (i.e. on the side close to the ground) the midfoot portion has a downwardly convexedly curved shape to form the void with the upper plate, the lower plate can deform upwardly, thereby securing the cushioning properties of the midfoot portion. As a result, when the load is transferred from the heel portion through the midfoot portion to the forefoot portion, a smooth load transfer is made possible and a ride feeling during running can be improved.

Moreover, in this case, since the upper plate disposed above (i.e. on the side close to the shoe wearer's foot) the midfoot portion is formed of a hard elastic member and the upper plate is connected to the lower plate via the connections at the front end side and the rear end side of the of the midfoot portion, deformation (i.e. bending and torsional deformation) of the upper plate can be further securely restrained when the load is applied to the midfoot portion. Thereby, the support rigidity relative to the arch portion of the wearer's foot can further improve and the stability as the midfoot portion of the shoe can be further secured.

In the first and second aspect of the present invention, the "void" formed between the upper plate and the lower midsole (or the lower plate) includes a true void with no filler filled in as well as a void with any soft cushioning member such as sponge filled in. In the case where the soft cushioning member filled in, a ride feeling during running can be improved and an entry of sand, dust and the like into the void can be blocked.

If the upper plate extends longitudinally in a generally flat shape or an upwardly convexedly curved shape at the midfoot portion, a downward deformation of the upper plate can be further effectively prevented when the load acts on the midfoot portion. Also, in this case, since the upper plate can be formed in a shape that follows the contour of the arch portion of the wearer's foot, fitting properties of the upper plate relative to the arch portion can be improved.

In contrast, if the upper plate has a downwardly convexedly curved shape, the upper plate easily deforms downwardly at time of the load action on the midfoot portion and lacks the stability as the midfoot portion of the shoe.

If the upper plate has a laterally advancing wavy shape with longitudinally extending ridge lines, a crest and/or a trough of the wavy shape of the upper plate functions as a rib and the upper plate is hard to bend in a V-shape viewed from the side. Thereby, a shank effect can be enhanced at the midfoot portion of the shoe.

If the upper midsole is provided on the upper surface of the upper plate, a contact feeling toward the sole of the wearer's foot can be improved.

If the lower plate of a downwardly convexedly curved shape is provided on the upper surface of the lower midsole to form a void with the upper plate, the bending and torsional rigidity of the entire midfoot portion can be increased.

If the hardness of the upper plate is greater than the hardness of the lower plate, when the load is applied to the midfoot portion, the lower plate of a relatively low hardness easily deforms upwardly to secure the cushioning properties and the upper plate of a relatively high hardness hardly deforms to enhance the support rigidity relative to the arch portion of the wearer's foot.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1:
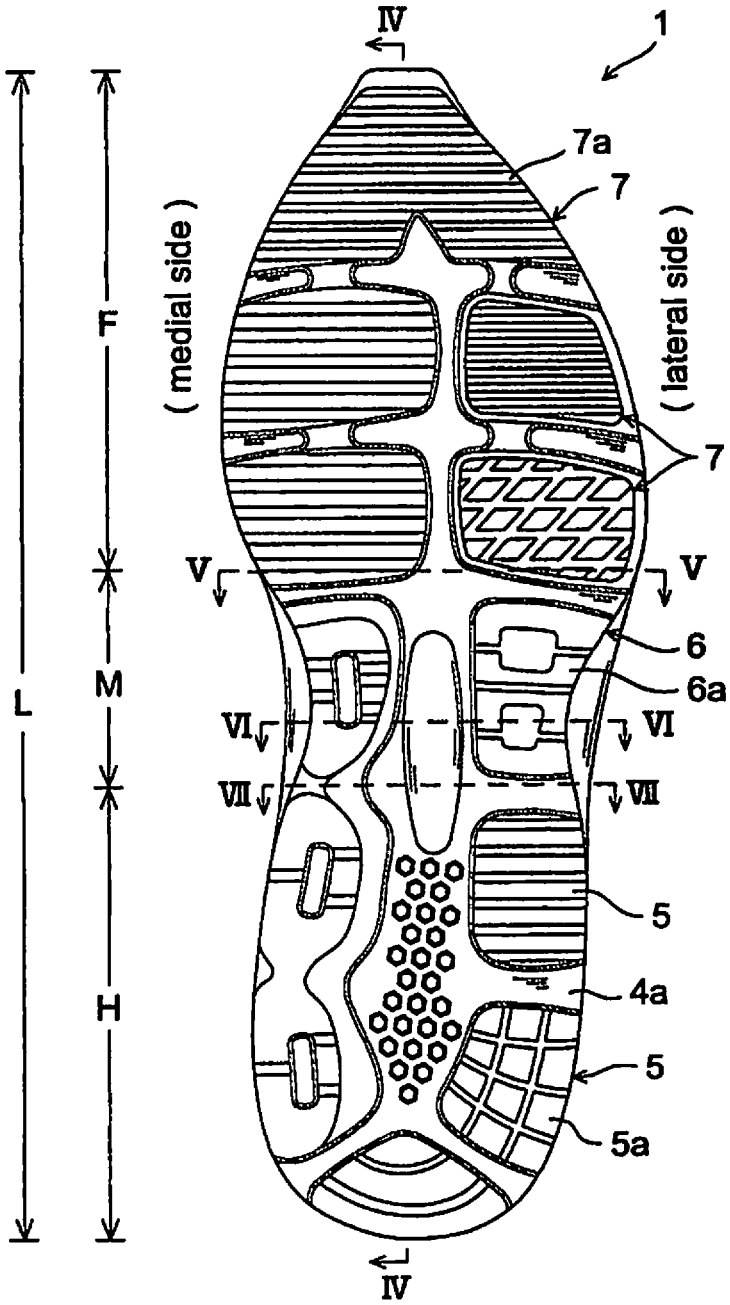
FIG. 1 is a bottom view of a sole assembly for a shoe according to an embodiment of the present invention.

Referring now to the drawings, FIGS. 1 to 7 show a midfoot structure of a sole assembly for a shoe according to an embodiment of the present invention.

As shown in FIGS. 1 to 4, a sole assembly 1 is composed of a heel portion H, a midfoot portion M, and a forefoot portion F. The midfoot portion M is disposed in a region defined by 0.35L to 0.55L, measuring from the heel rear end edge of the sole assembly 1 or the bottom end edge of FIG. 1, where L is the entire length of the sole assembly 1. Also, the rear end of the midfoot portion M or the boundary position relative to the heel portion H, is disposed in a position defined by 0.35L to 0.45L, measuring from the heel rear end edge of the sole assembly 1. The front end of the midfoot portion M or the boundary position relative to the forefoot portion F, is disposed in a position defined by 0.45L to 0.55L, measuring from the heel rear end edge of the sole assembly 1.

Figure 2:
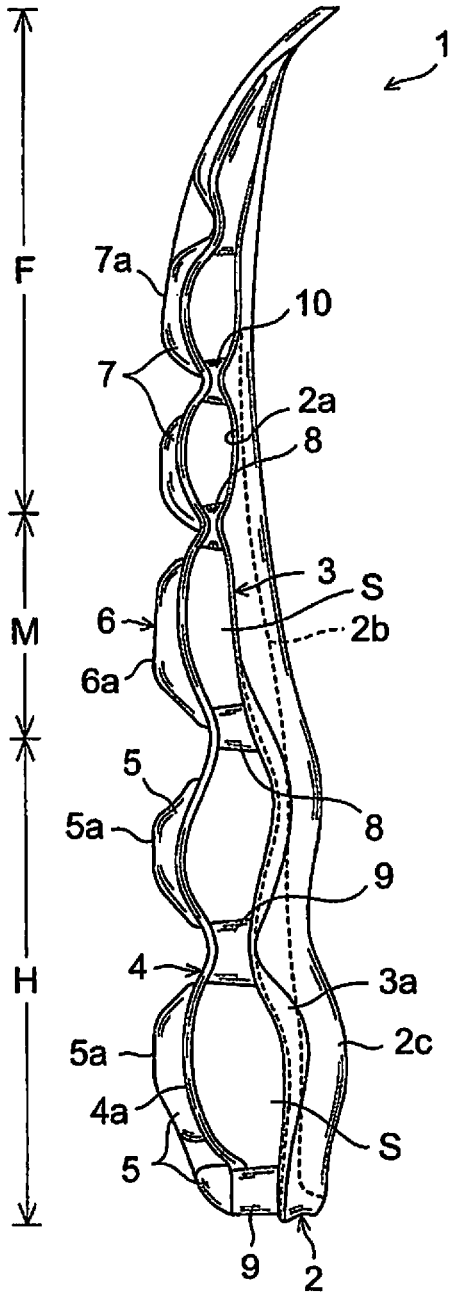
FIG. 2 is a lateral side view of the sole structure of FIG. 1.
Figure 3:
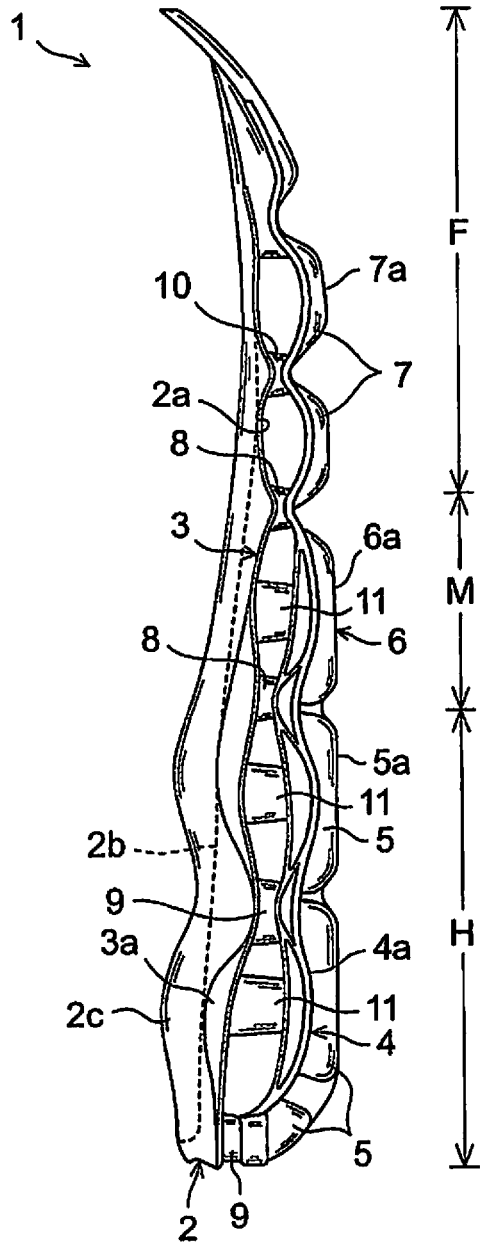
FIG. 3 is a medial side view of the sole structure of FIG. 1.

As shown in FIGS. 2 to 3, the sole assembly 1 includes an upper midsole 2 of a soft elastic member extending from the heel portion H through the midfoot portion M to the forefoot portion F, an upper plate 3 of a hard elastic member attached on the bottom surface 2*a* of the upper midsole 2 and extending from the heel portion H through the midfoot portion M to the forefoot portion F, a lower plate 4 of a hard elastic member disposed below the upper plate 3, extending from the heel portion H through the midfoot portion M to the forefoot portion F, and having a downwardly convexedly curved shape to form a void S with the upper plate 3, and outsoles 5, 6, 7 disposed on the bottom surface 4*a* of the lower plate 4.

The upper midsole 2 has an upper surface 2*b* that follows the contour of the sole of a shoe wearer's foot. On laterally opposite side edge portions of the upper surface 2*b*, a pair of upraised portions 2*c* are formed. The upraised portions 2*c* are adapted to be fixedly attached to the bottom portion of an upper of the shoe (not shown) when the upper is fitted to the upper midsole 2 at the time of assembly of the shoe. The bottom surface 2*a* of the upper midsole 2 is formed of a longitudinally advancing wavy surface with laterally extending ridge lines from the heel portion H to the forefoot portion F of the sole assembly 1. Preferably, the bottom surface 2*a* of the upper midsole 2 at the midfoot portion M is formed of an upwardly convexedly curved surface or a longitudinally flat surface.

The upper midsole 2 is preferably formed of a soft elastic member because it is disposed on the side close to the sole of the wearer's foot. For example, foamed thermoplastic resin such as ethylene-vinyl acetate copolymer (EVA), foamed thermosetting resin such as polyurethane (PU), and foamed rubber such as butadiene rubber or chloroprene rubber may be used.

The upper plate 3 has a wavy surface that extends from the heel portion H to the forefoot portion F of the sole assembly 1 and that follows the contour of the wavy surface of the bottom surface 2*a* of the upper midsole 2. On laterally opposite side edge portions of the upper plate 3, a pair of upraised wall portions 3*a* are formed. The upraised wall portions 3*a* are disposed on the laterally opposite side bottom portions of the upraised portions 2*c* of the upper midsole 2.

Figure 6:
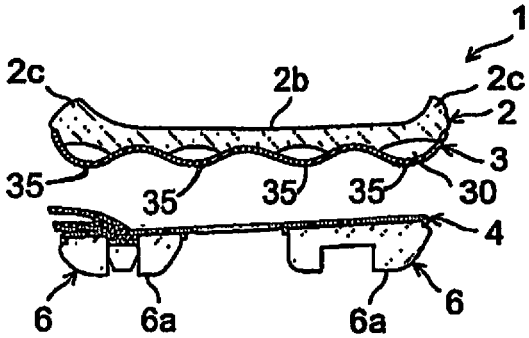
FIG. 6 is a cross sectional view of FIG. 1 taken along line VI-VI.

The upper plate 3 further has a laterally advancing wavy surface with the longitudinally extending ridge lines 35 at the longitudinally central portion of the midfoot portion M, as shown in FIG. 6. The bottom surface 2*a* of the upper midsole 2 contacting the wavy surface of the upper plate 3 at only some partial areas forms a plurality of cushion holes 30 at other non-contacting areas between the upper midsole 2 and the upper plate 3.

Figure 4:
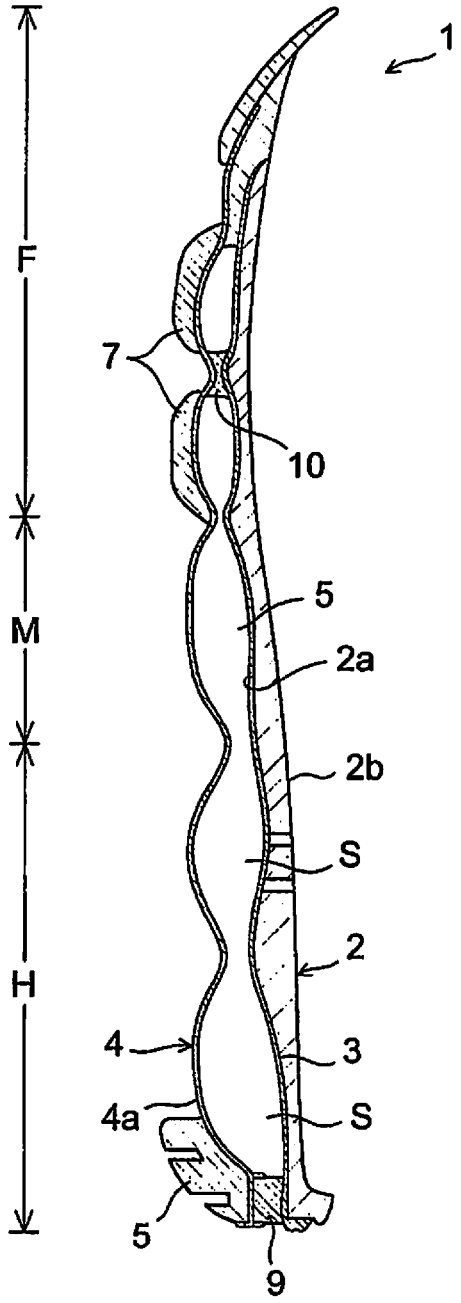
FIG. 4 is a longitudinal sectional view of FIG. 1 taken along line IV-IV.

The lower plate 4 has an inverted wavy shape relative to the upper plate 3. That is, the lower plate 4 has a downwardly convexedly curved shape at the position where the lower plate 4 faces the upwardly convexedly curved shape of the upper plate 3, and the lower plate 4 has an upwardly convexedly curved shape at the position where the lower plate 4 faces the downwardly convexedly curved shape of the upper plate 3. In addition, FIGS. 2 to 4 show the void S with no fillers filled in, but a soft cushioning member such as sponge may be filled in the void S.

The upper and lower plates 3, 4 are preferably formed of hard elastic plates in order to prevent a loss in elasticity due to repetitive deformation to maintain the shape of the void S between the plates 3 and 4 to some degree. The upper and lower plates 3, 4 may be formed of thermoplastic resin such as thermoplastic polyurethane (TPU), is polyamide elastomer (PAE), ABS resin or the like. Alternatively, the upper and lower plates 3, 4 may be formed of thermosetting resin such as epoxy resin, unsaturated polyester resin or the like. Also, the upper and lower plates 3, 4 may be formed of fiber reinforced plastics including carbon fibers or metal fibers.

The hardness of the upper plate 3 is preferably greater than the hardness of the lower plate 4. For example, the hardness of the upper plate 3 is set at a Shore D hardness of 72 and the hardness of the lower plate 4 is set at a Shore D hardness of 55.

Of all the outsoles provided on the bottom surface 4*a* of the lower plate 4, the outsole 5 is disposed at the heel portion H of the sole assembly 1, the outsole 6 at the midfoot portion M, and the outsole 7 at the forefoot portion F.

The outsoles 5, 7 at the heel portion H and the forefoot portion F have ground contact surfaces 5*a*, 7*a* and the outsole 6 at the midfoot portion M also has a ground contact surface 6*a*. As is clearly shown in FIG. 2, the ground contact surface 6*a* of the outsole 6 is longitudinally separated from the ground contact surfaces 5*a*, 7*a* of the outsoles 5, 7 at the heel portion H and the forefoot portion F. In other words, there is formed a clearance between the ground contact surface 6*a* of the outsole 6 and the ground is contact surfaces 5*a*, 7*a* of the outsoles 5, 7 that are longitudinally adjacent to the outsole 6. As shown in FIGS. 1 and 3, the outsoles 5, 6, and 7 may be interconnected to each other at the base portions.

Figure 5:
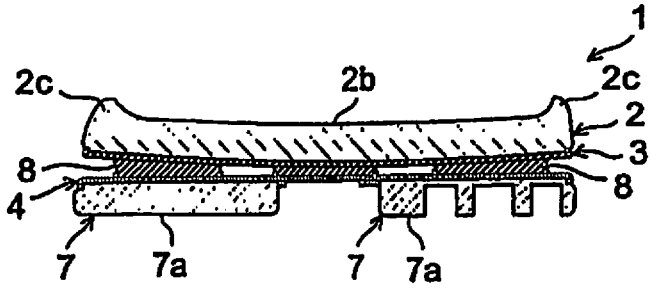
FIG. 5 is a cross sectional view of FIG. 1 taken along line V-V.
Figure 7:
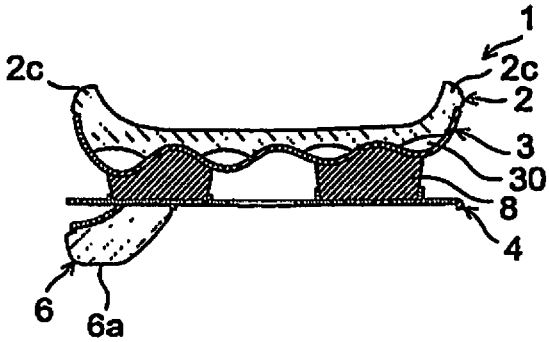
FIG. 7 is a cross sectional view of FIG. 1 taken along line VII-VII.

On the front and rear end sides of the midfoot portion M of the sole assembly 1, there are provided connections 8 of an elastic connection member to interconnect the upper plate 3 with the lower plate 4 in the vertical direction (see FIGS. 5 and 7). Similarly, a connection 9 is provided at the heel portion H and a connection 10 at the forefoot portion F. Each of the connections 8, 9, 10 is preferably disposed at the position where the upper plate 3 and the lower plate 4 are vertically closest to each other. That is, each of the connections 8, 9, 10 is provided at the position where the downwardly convexedly curved portion of the upper plate 3 faces the upwardly convexedly curved portion of the lower plate 4 in the vertical direction. The upper and lower ends of the connections 8, 9, 10 are fixedly attached to the upper and lower plates 3, 4. For example, each of the connections 8, 9, 10 is disposed at the laterally opposite end portions (and the central portion) of the sole assembly 1.

In the example shown in FIG. 3, there are provided a plurality of column-shaped reinforcement members 11 at the positions where the upper and lower plates 3, 4 are located farthest away from each other on the medial side of the sole assembly 1. These reinforcement members 11 are provided in the light of preventing an excessive downward sinking of the medial side portion and securing the stability of the sole assembly 1 when the load is applied to the medial side portion of the sole assembly 1. The upper end of each of the reinforcement members 11 is fixed to the upper plate 3 but the lower end of each of the reinforcement members 11 is not fixed to the lower plate 4 and has a gap (not shown) between the reinforcement member 11 and the lower plate 4. That is because when the load acts on the sole assembly 1 the upper and lower plates 3, 4 can deform to some degree and then by causing the end of the reinforcement member 11 to contact the lower plate 4 an excessive downward sinking of the upper and lower plates 3, 4 can be prevented. In addition, when the cushioning properties are regarded as important in the sole assembly, then preferably these reinforcement members 11 should be omitted.

In the above-mentioned sole assembly, since the outsole 6 separated longitudinally from the outsoles 5, 7 of the heel portion H and the forefoot portion F is provided at the midfoot portion M of the sole assembly, when the wearer to strikes onto the ground from the heel portion H of the sole assembly and the load is transferred toward the forefoot portion F the ground contact surface 6*a* of the outsole 6 at the midfoot portion M comes into contact with the ground. At this juncture, since the lower plate 4 disposed at the lower is position (i.e. the position close to the ground) in the midfoot portion M has a downwardly convexedly curved shape to form the void S with the upper plate 3, the lower plate 4 can deform upwardly thereby securing the cushioning properties of the midfoot portion M. As a result, when the load is transferred from the heel portion H through the midfoot portion M to the forefoot portion F a smooth load transfer is made possible and a ride feeling during running can be improved.

Also, in this case, since the upper plate 3 disposed at the upper position (i.e. the position close to the wearer's foot) in the midfoot portion M is formed of a hard elastic member and also the upper plate 3 is coupled to the lower plate 4 via the connections 8 on the front and rear end sides of the midfoot portion M, at the time of applying the load to the midfoot portion M deformation (i.e. bending and torsional deformation) of the upper plate 3 can be more securely prevented. Thereby, support rigidity relative to the arch portion of the wearer's foot can be further improved and the stability of the midfoot portion of the shoe can be further enhanced.

Moreover, in this case, since the upper plate 3 extends longitudinally in a generally flat shape or an upwardly convexedly curved shape at the midfoot portion M, at the time of applying the load to the midfoot portion M a downward sinking of the upper plate 3 can be more effectively prevented. Also, in this case, since the upper plate 3 can be formed in a shape that follows the contour of the arch portion of the foot of the wearer, fitting properties relative to the arch portion can be enhanced.

Furthermore, since the upper plate 3 has a laterally advancing wavy shape with longitudinally extending ridge lines 35, at the time of load-applying to the midfoot portion M the crests and/or troughs of the wavy configurations of the upper plate 3 function as longitudinal ribs so that the upper plate 3 is hard to bend in a V-shape as seen from a side view. Thereby, a shank effect at the midfoot portion M can be improved. Also, since the upper midsole 2 is provided on the upper plate 3, a contact feeling relative to the sole of the wearer's foot can be improved.

Moreover, if the hardness of the upper plate 3 is made greater than the hardness of the lower plate 4, when the load acts on the midfoot portion M the lower plate 4 of a relatively low hardness easily deforms upwardly to secure cushioning properties and the upper plate of a relatively high hardness is hard to deform thus increasing the support rigidity relative to the arch portion.

In the above-mentioned embodiment, the example was shown where the lower plate 4 is disposed opposite the upper plate 3 and the outsoles 5, 6, 7 are provided on the bottom surface 4*a* of the lower plate 4, but the present invention is not limited to such an example.

Figure 8:
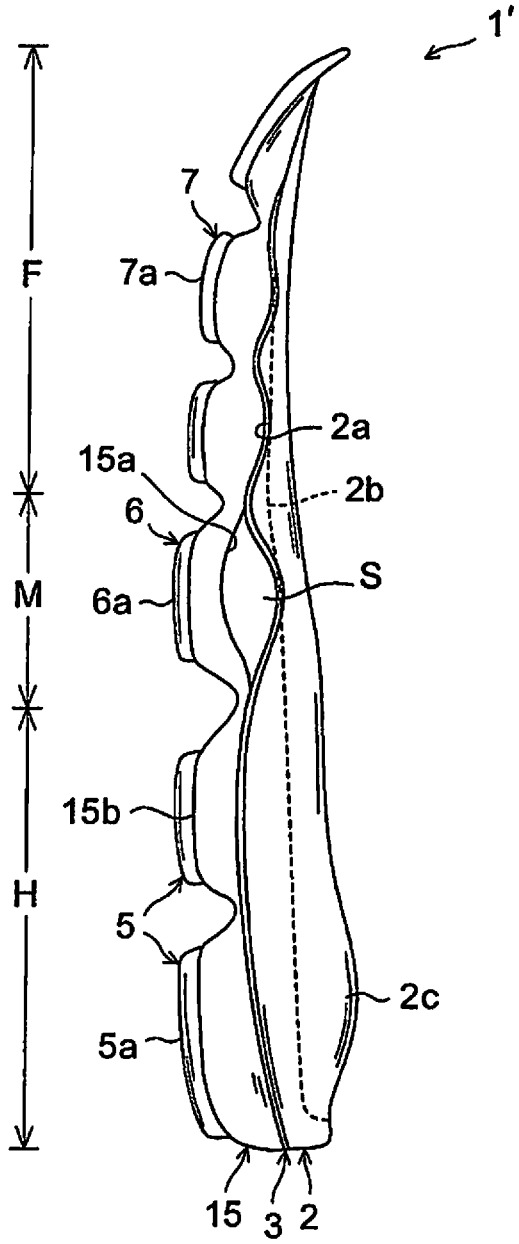
FIG. 8 is a side view of a sole assembly for a shoe according to another embodiment of the present invention.

FIG. 8 shows a side view of a sole assembly according to another embodiment of the present invention. In FIG. 8, like reference numbers indicate identical or functionally similar elements. In this sole assembly 1', the lower midsole 15 of a soft elastic member is provided in lieu of the lower plate 4 in the above-mentioned embodiment. The lower midsole 15 extends from the heel portion H through the midfoot portion M to the forefoot portion F under the upper plate 3 and has a downwardly convexedly curved upper surface 15*a* to form a void S with the upper plate 3. The lower midsole 15 is in contact with the upper plate 3 on the front and rear end sides of the midfoot portion M. In this example, the lower midsole 15 is in contact with the upper plate 3 at the heel portion H and the forefoot portion F as well.

The upper surface 15*a* of the lower midsole 15 has an inverted wavy shape relative to the upper plate 3. That is, the upper surface 15*a* of the lower midsole 15 has a downwardly convexedly curved surface at the position opposite the position where the upper plate 3 has an upwardly convexedly curved shape, and the upper surface 15*a* of the lower midsole 15 has an upwardly convexedly curved surface at the position opposite the position where the upper plate 3 has a downwardly convexedly curved shape.

The outsoles 5, 6, 7 are attached on the bottom surface 15*b* of the lower midsole 15. As with the above-mentioned embodiment, the outsole 5 is disposed on the heel portion H of the sole assembly 1, the outsole 6 on the midfoot portion M, and the outsole 7 on the forefoot portion F. The outsoles 5 of the heel portion H and the outsoles 7 of the forefoot portion F have ground contact surfaces 5*a*, 7*a* that contact the ground. Similarly, the outsole 6 of the midfoot portion M has a ground contact surface 6*a* that contacts the ground. The outsole 6 is longitudinally separated from the outsoles 5, 7 of the heel portion H and the forefoot portion F. In other words, there is a gap formed between the outsole 6 and the adjacent outsoles 5, 7.

In this case, because there is provided the outsole 6 at the midfoot portion M of the sole assembly, which is longitudinally separated from the outsoles 5, 7 at the heel portion H and the forefoot portion F, when the wearer impacts onto the ground from the heel portion H of the sole assembly and the load travels toward the forefoot portion F, the ground contact surface 6*a* of the outsole 6 comes into contact with the ground. At this juncture, since the lower midsole 15 disposed at the lower position (i.e. on the side close to the ground) of the midfoot portion M has a downwardly convexedly curved upper surface 15*a* to form the void S with the upper plate 3, the lower midsole 15 can deform upwardly thereby securing the cushioning properties of the midfoot portion M. As a result of this, when the load is transferred from the heel portion H through the midfoot portion M to the forefoot portion F, a smooth travel of the load becomes possible and a ride feeling during running can be improved.

Moreover, in this case, since the upper plate 3 disposed at the upper position (i.e. on the side close to the wearer's foot) of the midfoot portion M is formed of a hard elastic member, deformation (i.e. bending and torsional deformation) of the upper plate 3 can be restrained at the time of load-applying to the midfoot portion M. Thereby, the support rigidity relative to the arch portion of the wearer's foot can be improved and the stability of the midfoot portion of the shoe can be secured.

Figure 9:
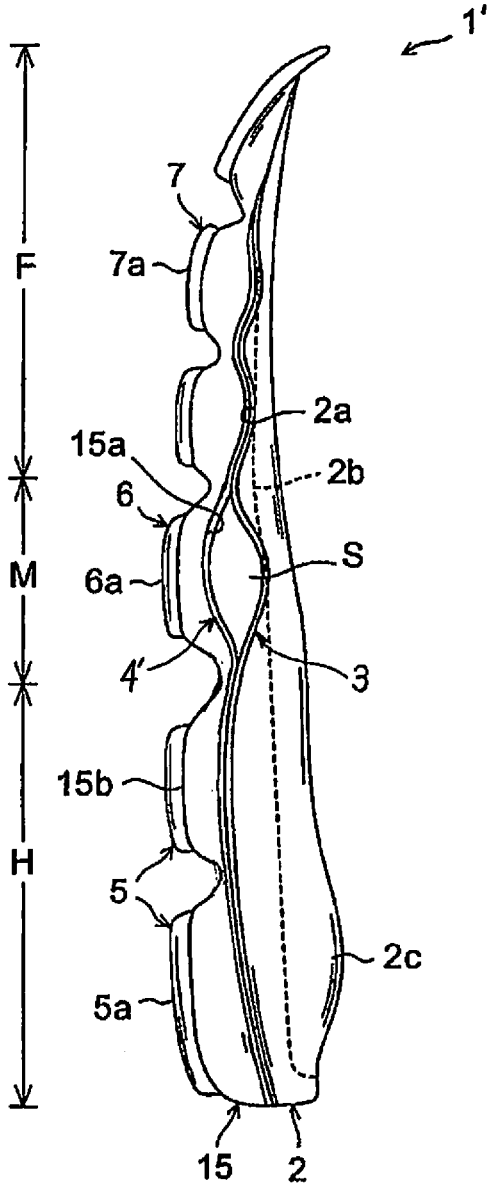
FIG. 9 is a side view of another sole assembly similar to that of FIG. 8, but additionally incorporating a feature similar to that of the embodiment of FIG. 1.

Furthermore, as shown in FIG. 9, a lower plate 4' of a hard elastic member may additionally be provided on the upper surface 15*a* of the lower midsole 15, whereby both the hard elastic lower plate 4' and the upper surface 15*a* of the soft elastic lower midsole 15 have a downwardly convexedly curved shape to form a void S relative to the lower plate 3. In this case, the bending rigidity as well as the torsional rigidity of the entire midfoot portion can be enhanced.

Those skilled in the art to which the invention pertains may make modifications and other embodiments employing the principles of this invention without departing to from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A sole assembly for a shoe including a midfoot structure comprising:

an upper plate disposed on an upper side of a midfoot portion of the sole assembly and formed of a hard elastic member, wherein the midfoot portion is located in a region corresponding to a plantar arch of a foot of a person wearing the shoe;

a lower midsole disposed below the upper plate at the midfoot portion, formed of a soft elastic member, having a downwardly convexedly curved upper surface to form a void with the upper plate, wherein the lower midsole is located below the void at the midfoot portion; and a midfoot outsole with a ground contact surface, wherein the midfoot outsole is attached on a lower surface of the lower midsole and located below the lower midsole at the midfoot portion, and is disposed discretely in a longitudinal direction from a heel outsole provided on a heel portion and a forefoot outsole provided on a forefoot portion of the sole assembly.

2. The sole assembly according to claim 1, further comprising a lower plate of a hard elastic member that is provided on the upper surface of the lower midsole, and that has a downwardly convexedly curved shape to bound the void between the upper plate and the lower plate.

3. The sole assembly according to claim 2, wherein the upper plate has a hardness greater than that of the lower plate.

4. The sole assembly according to claim 1, wherein the upper plate extends longitudinally in the longitudinal direction in a generally flat shape or an upwardly convexedly curved shape at the midfoot portion.

5. The sole assembly according to claim 1, wherein the upper plate has a laterally advancing wavy shape with longitudinal ridge lines extending along the longitudinal direction.

6. The sole assembly according to claim 1, further comprising an upper midsole of a soft elastic member attached on an upper surface of the upper plate.

7. The sole assembly according to claim 1, wherein the midfoot portion is disposed in the region which is defined by 0.35L to 0.55L, measuring from a heel rear end edge of the sole assembly, where L is an entire length of the sole assembly.

8. The sole assembly according to claim 7, wherein a rear end of the midfoot portion is disposed at a position defined by 0.35L to 0.45L, measuring from the heel rear end edge of the sole assembly, and a front end of the midfoot portion is disposed at a position defined by 0.45L to 0.55L, measuring from the heel rear end edge of the sole assembly.

9. The sole assembly according to claim 1, wherein the lower midsole extends continuously along the forefoot portion, the midfoot portion and the heel portion in the longitudinal direction.

* * * * *

UNITED STATES PATENT AND TRADEMARK OFFICE

CERTIFICATE OF CORRECTION

PATENT NO. : 8,567,093 B2
APPLICATION NO. : 13/013052
DATED : October 29, 2013
INVENTOR(S) : Natsuki Sato It is certified that error appears in the above-identified patent and that said Letters Patent is hereby corrected as shown below:

Title page,
Item (75) Inventor: replace “Kawanishi” by --Kawanishi-shi--;

In the Specifications,
Column 5,
Line 50, after “(TPU),” delete “is”;

Column 6,
Line 5, after “ground” delete “is”;
Line 50, after “wearer” delete “to”;
Line 55, after “at the lower” delete “is”;

Column 8,
Line 43, after “departing” delete “to”.

Signed and Sealed this
Twenty-fifth Day of March, 2014

Michelle K. Lee

Michelle K. Lee
*Deputy Director of the United States Patent and Trademark Office*